US006132869A

United States Patent [19]

Ohira et al.

[11] Patent Number: 6,132,869

[45] Date of Patent: Oct. 17, 2000

[54] VINYLIDENE FLUORIDE RESIN MONOFILAMENT AND FISHING LINE PREPARED THEREFROM

[75] Inventors: Seiichi Ohira, Ibaraki; Kazuyuki Munakata, Fukushima; Suguru Sato; Fumiya Mizuno, both of Ibaraki, all of Japan

[73] Assignee: Kureha Chemical Industry Co., Ltd., Japan

[21] Appl. No.: 09/403,420

[22] PCT Filed: Apr. 23, 1998

[86] PCT No.: PCT/JP98/01864

§ 371 Date: Oct. 21, 1999

§ 102(e) Date: Oct. 21, 1999

[87] PCT Pub. No.: WO98/48087

PCT Pub. Date: Oct. 29, 1998

[30] Foreign Application Priority Data

Apr. 23, 1997 [JP] Japan ..... 9-120360

[51] Int. Cl.[7] ..... D01F 6/10

[52] U.S. Cl. ..... 428/364; 478/394; 43/44.98

[58] Field of Search ..... 428/364, 394; 43/44.98

[56] References Cited

U.S. PATENT DOCUMENTS 4,667,001 5/1987 Mizuno ..... 521/255

FOREIGN PATENT DOCUMENTS 57-143511 9/1982 Japan .
62-502414 9/1987 Japan .
9-262047 10/1997 Japan .
WO 86/05739 10/1986 WIPO .

*Primary Examiner*—Newton Edwards
*Attorney, Agent, or Firm*—Nixon & Vanderhye P.C.

[57] ABSTRACT

A monofilament prepared from a vinylidene fluoride resin and satisfying the following relationship between the elastic modulus at a tensile elongation of 15% (Y15) and the initial elastic modulus (Y0): $0.85 \leqq (Y15/Y0) \leqq 1.3$, and a Y15 value ranging from 200 to 350 kg/mm$^2$; and a fishing line prepared from the monofilament and having a feature that undesirable curling is difficult to occur and, even when curling occurs, it can be readily relieved.

4 Claims, No Drawings

VINYLIDENE FLUORIDE RESIN MONOFILAMENT AND FISHING LINE PREPARED THEREFROM

TECHNICAL FIELD

The present invention relates to a monofilament formed of a vinylidene fluoride resin and to a fishing line formed of the monofilamnent, particularly a fishing line for fishing with a lure (hereinafter referred to as "lure fishing"). More particularly, the present invention relates to a monofilament formed of a vinylidene fluoride resin having an elastic modulus falling within a specific range. The monofilament of the present invention has a feature that undesirable curling—e.g., a phenomenon that curling of a monofilament occurs when the monofilament is released after being wound around a reel for a specific time—is difficult to occur and, even when curling occurs, it can readily be relieved so that the monofilament returns to the initial state, and is suitably used as a fishing line.

BACKGROUND ART

A monofilament formed of a vinylidene fluoride resin is used as a raw material for a fishing line or a fishing net, because the monofilament has excellent physical and chemical properties, inter alia, excellent mechanical strength and durability, and exhibits least deterioration in strength while immersed in water, due to substantially no swelling with water. Recently, fishing with a lure or with a casting net has become a popular sport, as part of the trend towards more and more people enjoying outdoor life. In such fishing, a spinning-type reel is predominantly employed. Therefore, desirable properties of a fishing line employed in such fishing are (1) excellent transmission of a strike; (2) flexibility and curling that is easy to relieve during use: and (3) excellent strength characteristics, particularly high tensile strength when tied.

There exists demand for a fishing line that completely satisfies all the above properties or a fishing line that satisfies all the above properties to a considerable degree, one of the properties predominating so as to suit a specific method of fishing.

In view of the foregoing, an object of the present invention is to provide a monofilament formed of a vinylidene fluoride resin having a feature that undesirable curling is difficult to occur and, even when curling occurs, it can readily be relieved so that the monofilament returns to the initial state. Another object of the invention is to provide a fishing line formed of the monofilament. Still another object of the invention is to provide a fishing line formed of the monofilament for lure fishing.

The present inventors have conducted earnest studies, and have found that a monofilament formed of a vinylidene fluoride resin having a ratio of the elastic modulus at a certain elongation to that at another elongation that falls within a specific range and an elastic modulus at a specific elongation that falls within a specific range exhibits a feature that undesirable curling is difficult to occur and, even when curling occurs, it can readily be relieved so that the monofilament returns to the initial state. The present invention has been accomplished based on this finding.

DISCLOSURE OF THE INVENTION

Accordingly, the present invention provides a monofilament formed of a vinylidene fluoride resin, which satisfies a relationship between the elastic modulus at a tensile elongation of 15% (Y15) and the initial elastic modulus (Y0) of $0.85 \leqq (Y15/Y0) \leqq 1.3$, with a Y15 value ranging from 200 to 350 kg/mm$^2$. Preferably, the monofilament has a tensile elongation of 30–50%. The present invention also provides a fishing line formed of the monofilament. Further, the present invention also provides a fishing line formed of the monofilament for lure fishing. The monofilament according to the present invention is transparent, and has appropriate mechanical strength and a feature that undesirable curling is difficult to occur and, even when curling occurs, it can readily be relieved so that the monofilament returns to the initial state. Therefore, the monofilament is suitable for a fishing line, particularly a fishing line for lure fishing.

BEST MADE FOR CARRYING OUT THE INVENTION

The vinylidene fluoride resin used in the present invention includes PVDF (vinylidene fluoride resin). Examples of the preferable vinylidene fluoride resin include a vinylidene fluoride homopolymer, a copolymer containing 70 mol % or more of vinylidene fluoride structural units, and a mixture thereof. Examples of the monomer which is copolymerized with vinylidene fluoride include ethylene tetrafluoride, propylene hexafluoride, ethylene trifluoride, ethylene trifluoride chloride, and vinyl fluoride. At least one of these may be used as a comonomer. The vinylidene fluoride resin preferably has an inherent viscosity ($\eta_{inh}$) of 0.8–2.0 dl/g, more preferably 1.0–1.7 dl/g.

Into the vinylidene fluoride resin serving as a raw material of the monofilament of the present invention, so long as the intrinsic properties of the resin are not impaired, there may be incorporated additives such as organic pigments; a plasticizer of a polyester; a plasticizer of a phthalate ester; a nucleating agent such as flavanthrone; or a composition containing a resin which has high compatibility to a vinylidene fluoride resin such as poly(methyl methacrylate), poly(methyl acrylate), or a methyl acrylate-isobutylene copolymer. Particularly, a polyester having a molecular weight of 1500–4000; comprising structural repeating units of an ester formed of a C2–C4 diol and a C4–C6 dicarboxylic acid; and having a terminal group formed of a C1–C3 monovalent acid residue or monohydric alcohol residue is preferably used as a plasticizer.

The monofilament of the present invention exhibits a relationship between the elastic modulus at a tensile elongation of 15% (Y15) and the initial elastic modulus (Y0) as follows: $0.85 \leqq (Y15/Y0) \leqq 1.3$, preferably $0.95 \leqq (Y15/Y0) \leqq 1.15$, and a Y15 value of 200–350 kg/mm$^2$, preferably 230–320 kg/mm$^2$. However, in the case where that the elastic modulus (Y15) is less than 200 kg/mm$^2$, even when the ratio of (Y15/Y0) falls within the range of 0.85 to 1.3, the monofilament has poor mechanical strength and voids are generated in a fishing line during application of tension to thereby cause blushing and possibly loss of transparency. When the elastic modulus (Y15) is in excess of 350 kg/mm$^2$, curling cannot be relieved. Thus, the elastic modulus (Y15) should fall within the above-described range.

In contrast, in the case where the ratio (Y15/Y0) is less than 0.85 or in excess of 1.3, even when the above-described elastic modulus (Y15) falls within the range of 200 to 350 kg/mm$^2$, the mechanical strength is too low and thus is unsatisfactory for use as a fishing line or curling is not easily relieved. Thus, the relationship $0.85 \leqq (Y15/Y0) \leqq 1.3$ should be assured.

Furthermore, when the above-described monofilament has a tensile elongation of 30–50%, curling is easily relieved. Such a monofilament is suitably used as a fishing line for lure fishing having appropriate mechanical strength.

A preferable, non-limiting process for producing the monofilament of the present invention will next be described. For example, a composition containing PVDF (100 parts by weight) and a plasticizer (0.5–8.0 parts by weight) is melt-extruded to form pellets thereof, which are melt-spun by use of a 35-mmϕ extruder at a resin temperature of 260° C. (240–280° C.). The resultant filament is sequentially quenched in water (30–60° C.), drawn at a draw ratio of approximately 5.0–5.6 in a glycerin bath at 160° C. (150–170° C.) (first stage drawing) and drawn at a draw ratio of 1.00–1.20 in a glycerin bath at 170° C. (160–175° C.) (second stage drawing). Subsequently, the drawn filament is subjected to relaxation for 2–10% in hot air flow at 85° C. Although drawing may be carried out in a single stage or in two stages, the ultimate draw ratio after completion of the relaxation step is preferably 5.1–5.8, more preferably 5.2–5.7. The elastic modulus at elongation of the monofilament can be modified by changing the draw ratio. When the draw ratio is excessively high, curling is not easily relieved, whereas when the ratio is very low, the fishing line produced from the monofilament has poor mechanical strength. Thus, preferably, the draw ratio is selected appropriately upon production of a monofilament in accordance with the object. No particular limitation is imposed on the filament diameter, and the diameter is preferably 50 μm (No. 0.1) to 1.85 mm (No. 120), more preferably 90–500 μm.

The thus-obtained monofilament is transparent, and has appropriate mechanical strength and a feature that undesirable curling is difficult to occur. Therefore, the monofilament is suitable for a fishing line, particularly a fishing line for lure fishing.

EXAMPLES

The present invention will next be described in more detail by way of examples, which should not be construed as limiting the invention thereto.

Evaluation Methods

Curl: A monofilament sample having a length of approximately 50 m was wound around a small spool having a diameter of 44 mm, and allowed to stand at room temperature for one month. Thereafter, the sample was taken from the spool in a length of 1 m (hereinafter such a length is referred to as "a"). The sample was hung with one end thereof being fixed, and the perpendicular length from the end to the bottom level of the pendant sample (hereinafter such a length is referred to as "b") was measured. The ratio of b to a (hereinafter this ratio is referred to as "c") served as an index showing the degree of curling. When curling does not occur, c equals 1. Curling induced from the shape of a spool increases as the value of c decreases. This phenomenon shows the ease with which curling occurs.

Subsequently, a 500-g weight was fixed at the other end of the sample, and the sample was allowed to stand for 5 minutes. After removal of the weight, the perpendicular length from the top end to the bottom of the pendant sample (hereinafter such a length is referred to as "d") was measured. The ratio of d to a (hereinafter this ratio is referred to as "e") served as an index showing the relievability of curling. When curling is completely relieved, e equals 1. A value of e approximating shows that curling is easily relieved.

Elastic modulus (Y15) at a tensile elongation of 15% and initial elastic modulus (Y0): A tensile test was performed for a sample having a length of 300 mm by use of Tensilon (model UTM-III, product of Orientec Corp.) at a crosshead speed of 300 mm/minute. The initial elastic modulus and the elastic modulus at a tensile elongation of 15% were calculated from the obtained stress-strain curves. The initial elastic modulus was determined by measurement of stress at various points between the initial point which corresponds to 0% load and the final point which corresponds to 2% load, at intervals of 0.5%; while the elastic modulus at a tensile elongation of 15% was measured from the elongation of 14% to that of 16% at intervals of 2 mm. The obtained data were processed by use of software for data processing (product of Orientech), to thereby calculate the above modulus.

Blushing of a filament: During the tensile test, a blushing condition was visually observed until the sample was broken.

Tensile strength/elongation for samples having no knots and for samples having knots: The tensile strength and elongation were obtained through a tensile test performed for a sample having a length of 300 mm by use of Tensilon (model UTM-III, product of Orientec Corp.) at a crosshead speed of 300 mm/minute. The tensile strength and elongation for a sample having a knot at the midpoint of the sample were obtained similarly.

Example 1

PVDF ($\eta_{inh}$=1.3 dl/g) was melt-spun by use of a 35-mmϕ extruder at a resin temperature of 265° C. The resultant monofilament was cooled in water at 40° C., to thereby produce an undrawn filament having a filament diameter of 570 μm. The filament was drawn at a draw ratio of 5.2 in a 165° C. glycerin bath, and further drawn in a 170° C. glycerin bath so as to provide an ultimate draw ratio of 5.7. The thus-drawn filament was subjected to 5% relaxation at 85° C. for 3 seconds, to thereby obtain a drawn filament having a filament diameter of 245 μm. The conditions for production of the filament are shown in Table 1 and the ratio (Y15/Y0) and evaluations of curling are shown in Table 2.

Comparative Examples 1 to 4

PVDF used in Example 1 was drawn under the conditions shown in Table 1, to thereby obtain drawn filaments. The ratio (Y15/Y0) and evaluations of curling for these filaments are shown in Table 2.

Example 2

In a similar manner as described in Example 1, an undrawn filament having a filament diameter of 690 μm was produced. The filament was drawn at a draw ratio of 5.3 in a 165° C. glycerin bath, and further drawn in a 170° C. glycerin bath so as to provide an ultimate draw ratio of 5.57. The thus-drawn filament was subjected to 6% relaxation at 85° C. for 5 seconds, to thereby obtain a drawn filament having a filament diameter of 301 μm. The conditions for production of the filament are shown in Table 1 and the ratio (Y15/Y0) and evaluations of curling are shown in Table 2.

Example 3

In a similar manner as described in Example 1, an undrawn filament having a filament diameter of 410 μm was produced. The filament was drawn at a draw ratio of 5.6 in a 165° C. glycerin bath, and further drawn in a 170° C. glycerin bath so as to provide a final drawn ratio of 5.82. The drawn filament was subjected to 3% relaxation at 85° C. for 3 seconds, to thereby obtain a drawn filament having a filament diameter of 172 mim. The conditions for production of the filament are shown in Table 1 and the ratio (Y15/Y0) and evaluations of curling are shown in Table 2.

TABLE 1

| | 1st stage drawing | | 2nd stage drawing | | Relaxation | | Ultimate |
|---|---|---|---|---|---|---|---|
| | ratio | temp. (° C.) | ratio | temp. (° C.) | ratio | temp. (° C.) | draw ratio |
| Ex. 1 | 5.2 | 165 | 1.10 | 170 | 0.95 | 85 | 5.43 |
| Comp. Ex. 1 | 5.8 | 165 | 1.09 | 170 | 0.95 | 85 | 6.01 |
| Comp. Ex. 2 | 4.5 | 160 | 1.10 | 170 | 0.97 | 85 | 4.80 |
| Comp. Ex. 3 | 5.9 | 165 | 1.15 | 170 | 0.97 | 85 | 6.58 |
| Comp. Ex. 4 | 5.5 | 165 | 1.10 | 170 | 0.95 | 85 | 5.75 |
| Ex. 2 | 5.3 | 165 | 1.05 | 170 | 0.94 | 85 | 5.23 |
| Ex. 3 | 5.6 | 165 | 1.04 | 170 | 0.97 | 85 | 5.65 |

TABLE 2

| | Filament diam. (μ) | Tensile Properties (without knots) strength kg/mm² | elongation % | Tensile properties (with knots) strength kg/mm² | elongation % | Y15/Y0 | Y15 kg/mm² |
|---|---|---|---|---|---|---|---|
| Ex. 1 | 245 | 77 | 38 | 62 | 32 | 1.03 | 266 |
| Comp. Ex. 1 | 233 | 85 | 25 | 68 | 20 | 1.20 | 400 |
| Comp. Ex. 2 | 260 | 65 | 52 | 48 | 47 | 1.10 | 185 |
| Comp. Ex. 3 | 223 | 90 | 17 | 65 | 15 | 1.47 | 527 |
| Comp. Ex. 4 | 236 | 80 | 30 | 63 | 26 | 1.43 | 330 |
| Ex. 2 | 301 | 75 | 41 | 60 | 35 | 1.02 | 248 |
| Ex. 3 | 172 | 80 | 36 | 65 | 32 | 1.10 | 322 |

| | Curing of filament C*1 | e*2 | Blushing of filament |
|---|---|---|---|
| Ex. 1 | 0.92 | 0.98 | no |
| Comp. Ex. 1 | 0.76 | 0.86 | no |
| Comp. Ex. 2 | 0.96 | 0.99 | blush |
| Comp. Ex. 3 | 0.68 | 0.80 | no |
| Comp. Ex. 4 | 0.82 | 0.93 | no |
| Ex. 2 | 0.93 | 0.98 | no |
| Ex. 3 | 0.90 | 0.98 | no |

*1Curling resistance
*2Curling relievability

As is clear from Tables 1 and 2, the monofilament of Comparative Example 1has poor tensile elongation, and curling easily occurs and cannot be easily relieved. The monofilament of Comparative Example 2 has poor strength and generates blushing in accordance with application of tension, although curling is difficult to occur and can easily be relieved. The monofilament of Comparative Example 3 has excessive (Y15/Y0) and Y15, and curling easily occurs and cannot be easily relieved. The monofilament of Comparative Example 4 has an excessive (Y15/Y0), and curling easily occurs, although curling can easily be relieved.

INDUSTRIAL APPLICABILITY

As described hereinabove, the monofilament of the present invention has a feature that undesirable curling is difficult to occur and, even when curling occurs, it can readily be relieved so that the monofilament returns to the initial state, and is suitably used as a fishing line, particularly as a fishing line for lure fishing.

We claim:

1. A monofilament formed of a vinylidene fluoride resin, which satisfies the following relationship between the elastic modulus at a tensile elongation of 15% (Y15) and the initial elastic modulus (Y0):

$0.85 \leqq (Y15/Y0) \leqq 1.3$, and a Y15 value ranging from 200 to 350 kg/mm².

2. The monofilament according to claim 1, which has a tensile elongation of 30–50%.

3. A fishing line formed of a monofilament according to claim 1 or 2.

4. A fishing line according to claim 3 for lure fishing.

* * * * *